United States Patent [19]

Yamakuchi et al.

[11] Patent Number: 4,915,383

[45] Date of Patent: Apr. 10, 1990

[54] BASE FOR LITTLE LEAGUE BASEBALL FIELD

[76] Inventors: Betty F. Yamakuchi; Muneyoshi Yamakuchi, both of 3434 N. Hamilton Ave., Chicago, Ill. 60618

[21] Appl. No.: 241,695

[22] Filed: Sep. 8, 1988

[51] Int. Cl.[4] ..... A63C 69/40

[52] U.S. Cl. ..... 273/25

[58] Field of Search ..... 273/25; 135/118; 403/206, 209, 397; 223/95, 223, 224; 24/140; 29/441, 443

[56] References Cited

U.S. PATENT DOCUMENTS

| | | | |
|---|---|---|---|
| 1,268,459 | 6/1918 | Hjermstad | 135/118 |
| 2,046,126 | 6/1936 | Latina | 273/25 |
| 2,471,736 | 5/1949 | Fleming et al. | 273/25 |
| 3,838,801 | 10/1974 | David | 223/99 |
| 3,840,161 | 10/1974 | Pearce | 223/99 |

*Primary Examiner*—T. Brown

*Attorney, Agent, or Firm*—Milton S. Gerstein

[57] ABSTRACT

An improved base assembly for a Little League baseball field in which there are provided a plurality of staking pins connected to the strap end portions of the base via a plurality of metal clips, each metal clip having one loop for receiving therethrough a respective strap end portion, another loop for slidingly receiving therein a respective staking pin. During the securement of the base to the ground, the staking pins are hammered into the ground, and, owing to the spacing of the staking pins from the straps and the side surfaces of the base, the hammer blows contact only the skating pins. An insertion tool is provided for inserting a new strap into the base which includes a substantially elongated flat metal member having an enlarged end in which is formed a coutout for threading therethrough a first free end of a new strap. After such threading, the whole tool, along with the inserted free end of the new strap, is threaded or pushed through a pair of diametrically-opposed channel slots formed in the upper surface of the base.

7 Claims, 2 Drawing Sheets

FIG. 1
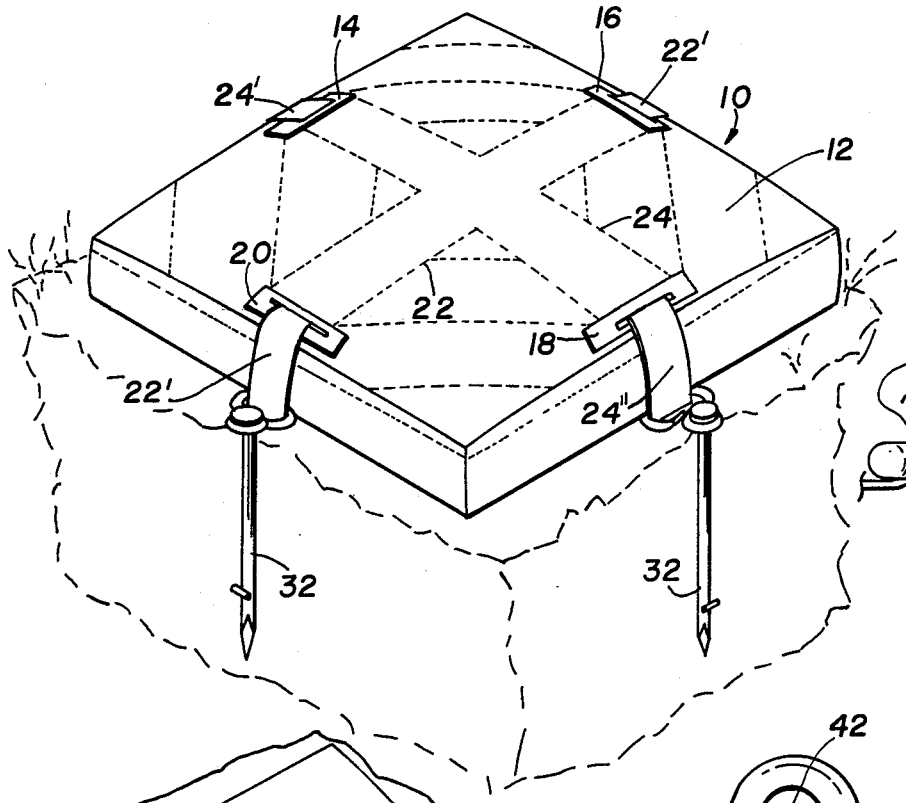
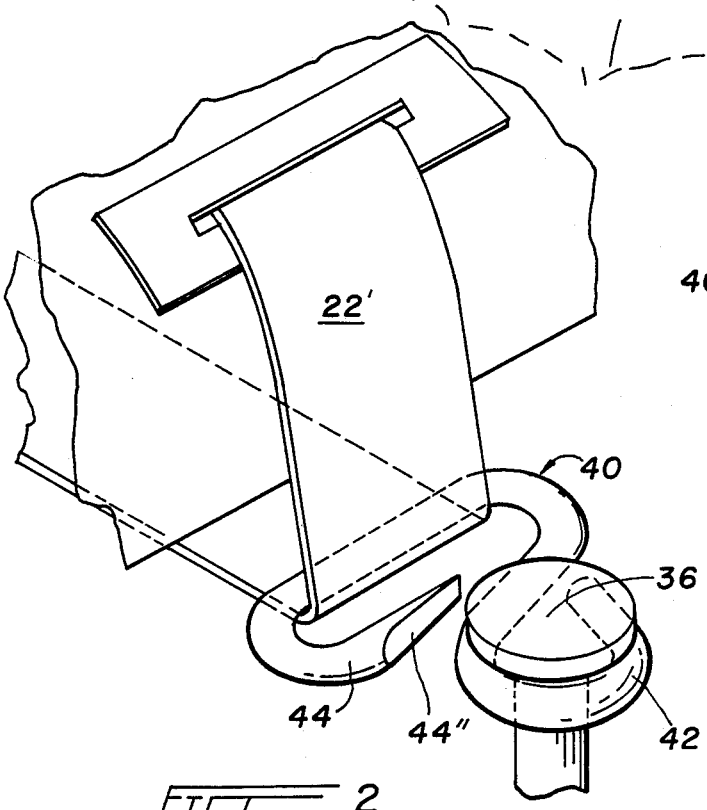
FIG. 2
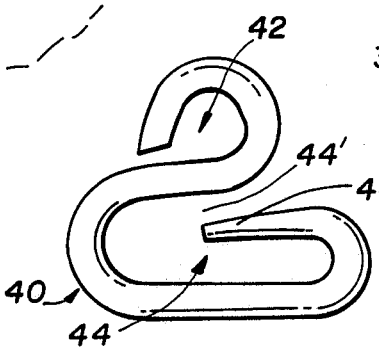
FIG. 4
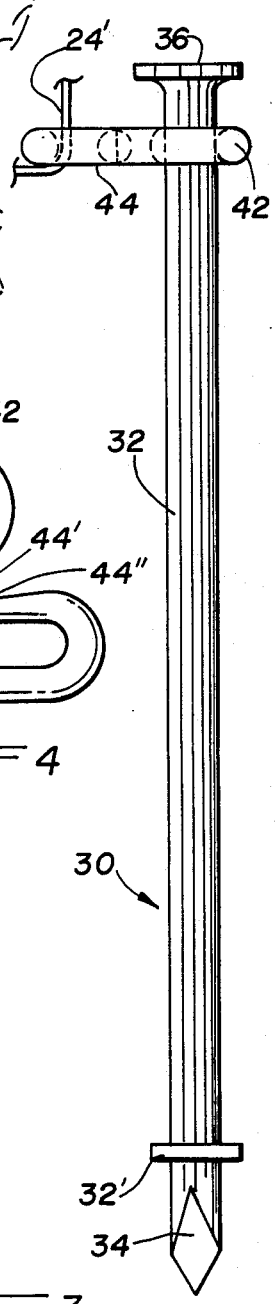
FIG. 3

60
16
62'
12
33
20
35

66
60
64
63
60
62
62'

64'
16
10
64

60
35
64
16
10
22

BASE FOR LITTLE LEAGUE BASEBALL FIELD

BACKGROUND OF THE INVENTION

The present invention is directed to a base assembly for use in a Little League baseball field, or the like, which base assembly of the present invention has a much longer lifespan, and is more safely secured to the ground. The prior art base assemblies for Little League baseball fields, as well as more advanced leagues, typically include a base which is provided with straps on a surface of the base, which straps are used in securing the base to the ground via four staking pins, each staking pin substantially lying adjacent to a respective side surface of the base, and passing interiorly through a projecting portion of a strap end at the respective side surface of the base. It has been, however, the problem with these prior art base assemblies, in the manner of securement to the ground below, that the driving in of the staking pin via a hammer, or the like, has, over time, caused the wearing away and breaking of the strap portion associated with the strap end by which the staking pin secures the base proper to the ground. This occurs because the hammer blows very often actually strike the strap portion itself, either alone or in addition to the enlarged head of the staking pin. Often, when the strap or straps are broken due to use, as described above, one is faced with the only option of purchasing a brand new base, since it is cost ineffective and extremely difficult to replace the straps after they have been severed or broken. Thus, even though the remainder of the base is perfectly intact, if only one portion of a strap is broken or severed, the entire base is usually rendered irreparable and discarded, necessitating the purchase of a brand new base, and the associated increased costs associated therewith.

SUMMARY OF THE INVENTION

It is, therefore, the primary objective of the present invention to provide an improved base assembly for Little League baseball fields, and the like, in which the securement of the base to the ground below is achieved without adversely affecting the strap portions in associated with the staking pins, so as to not sever or break any portion of the strap, in order to increase the lifespan of the base.

It is another objective of the present invention to provide such a Little League base assembly which is provided with a plurality of improved staking pins, each stacking pin having a enlarged head portion at the top thereof, which head portion is spaced from the base proper as well as from the strap end portions, so that the hammer blows never contact the strap end portions associated with the staking pin, thereby rendering the straps completely free from the hammer blows and any associated severing or breakage thereof, to increase the lifespan of the straps and therefore the base proper.

It is still another objective of the present invention to provide such staking pins which provide an easier and faster manner of driving them into the ground, without any interference from the base proper or from the strap end portions associated with the staking pins, in contradistinction to the prior art base assemblies.

It is yet another objective of the present invention to provide a tool by which, if one of the straps of the base were severed or broken, a new strap may be easily and facilely inserted into the base, thereby obviating the need of purchasing a brand new house, thereby saving on costs.

Toward these and other ends, the improved base assembly of the present invention utilizes a standard Little League base, in which there is provided a pair of intersecting straps on the undersurface thereof, the strap end portions at each mid-portion of the side surfaces of the base constituting that portion of the strap by which the base is to be secured to the ground therebelow via a staking pin of the invention. The present invention is directed to an improved staking pin by which the base is secured to the ground via the strap end portions. Each staking pin of the present invention comprises a generally elongated metal rod member pointed at its lower end, for driving insertion into the ground, and an upper enlarged head for receiving hammer blows for driving the staking pins into the ground. Operatively associated with the staking pin is a specially-designed clip, which clip, in the preferred embodiment, defines a first loop portion which receives therethrough, in a sliding manner, the main elongated rod member portion of a staking pin, so that the clip itself may be slid relative to the staking pin. The clip of the invention also includes a second loop portion which has an open end thereof, which second loop portion receives therein the portion of the end of the respective strap associated with that side of the base, so that, as the staking pin is driven into the ground, the base is secured therewith via the respective strap end portion passing through the second loop. The staking pin is also provided with an end limit member at the end of the staking pin adjacent the sharpened point, in order to prevent the removal of the clip. Also according to the present invention, when a strap has been broken, and thereby rendered useless for securing the base to the ground, the tool of the present invention is provided by which a new strap may be threaded or inserted through the appropriate slots in the upper surface of the base, by which the new strap may again be used for securing the base to the ground therebelow via the staking pins of the present invention, thereby saving on cost in that an entire new base need not be purchased.

BRIEF DESCRIPTION OF THE DRAWINGS

The invention will be more readily understood with reference to the accompanying drawings, wherein:

FIG. 1 is an isometric view showing the improved base assembly of the present invention incorporating therein the four staking pins according to the present invention;

FIG. 2 is an isometric view showing, in detail, the manner by which the strap end portion is secured to the staking pin of the present invention via the clip of the invention, coupling the staking pin to the strap end portion of the base;

FIG. 3 is a side elevational view of the staking pin of the present invention, with the clip of the invention connected thereto for coupling the staking pin and a respective strap end portion of the base;

FIG. 4 is a top plan view of the clip of the present invention used for coupling the staking pin and the respective strap end portion of the base;

DETAILED DESCRIPTION OF THE DRAWINGS

Figures 5, 6, 7, 8, 9:
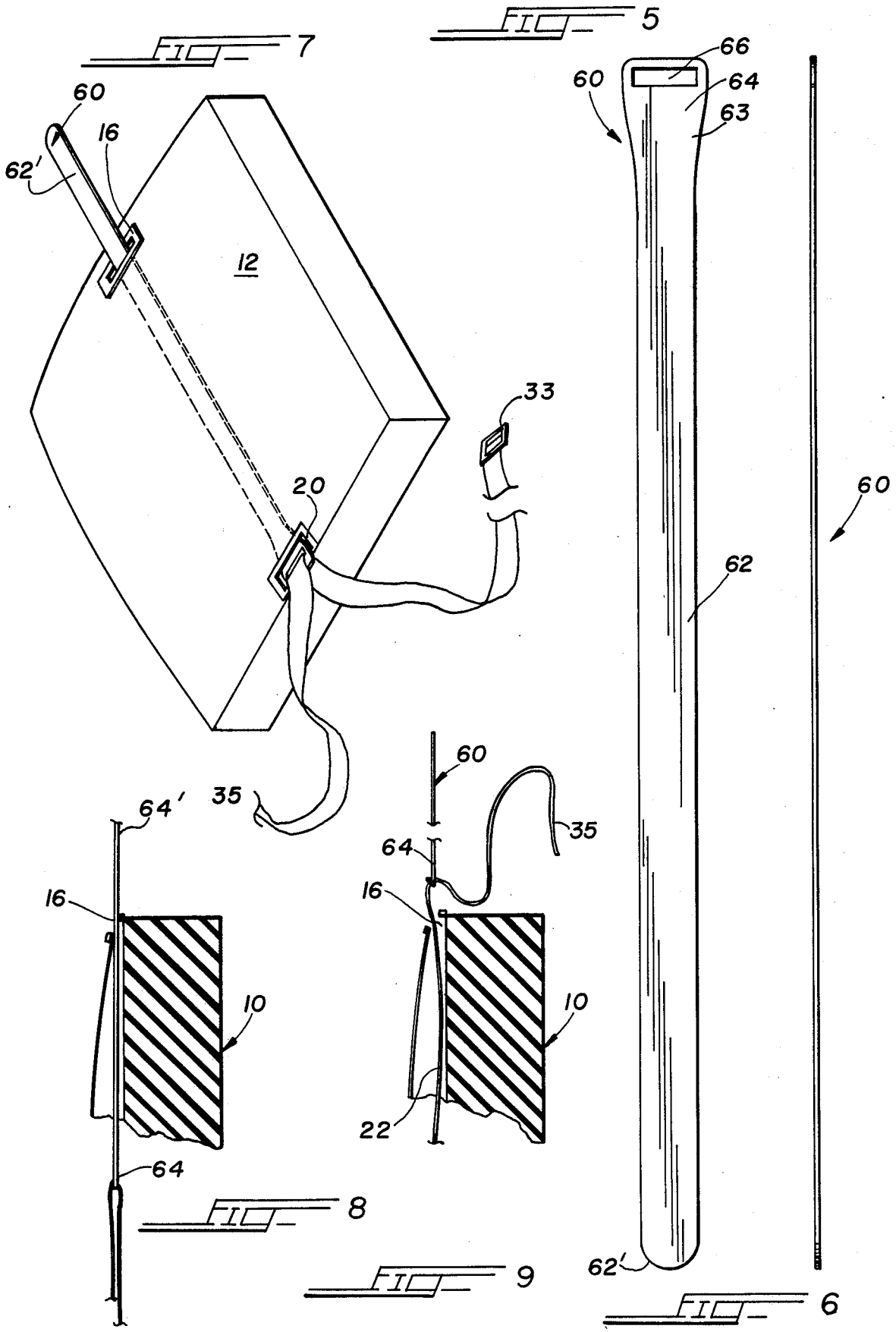
FIG. 5 is a top plan view of the tool of the present invention for threading or inserting a new strap into the upper surface of the base after an old strap has broken or severed.
FIG. 6 is a side view of the tool for inserting a new strap.
FIG. 7 is an isometric view of a base assembly during the process of inserting a new strap into the upper surface thereof via the tool of FIG. 5.
FIG. 8 is a detailed cross-sectional view showing the manner of inserting a new strap into the undersurface of a base, using the tool of FIG. 5.
FIG. 9 is a detailed sectional view, similar to FIG. 8, showing the completion of the insertion of a new strap into the base via the tool of FIG. 5.

Referring now to the drawings in greater detail, there is show in FIG. 1 a conventional Little League base, indicated generally by reference numeral 10. The base 10 proper includes a central core made of a relatively firm material, which is encased in an outer cloth covering, which is visible in FIG. 1. The base 10 includes an upper surface 12, constituted by the upper surface of the outer cloth covering, which is provided with four channels or slots 14, 16, 18 and 20, the channels or slots 16 and 20 being used for passing, through the undersurface of the upper surface 12, a first strap portion 22, while the channels 14 and 18 are used for passing, through the undersurface of the upper surface 12, a second strap portion 24, which straps 22 and 24 criss-cross in the interior of the cloth covering beneath the upper surface 12 thereof, as shown by dotted lines in FIG. 1. As is conventional, each of the straps 22, 24 has a buckle or fastener at one respective end, which allows the passage of the other end of the respective strap, so that the respective strap may be fastened and secured to the base proper by passing the other end through the fastener or buckle of the one end, adjacent the lower surface of the base 10. After each of the straps 22, 24 has been secured to the base, each of the straps will define a closed loop, where the end portions of the straploops projecting outwardly from and entraining the side faces or walls of the base proper are used for securing the base to the ground therebelow via four staking pins. The staking pins in the prior art are simply a main rod portion having an upper driving enlarged head portion and a lower pointed portion, which prior art staking pin has been simply inserted through the area between the loop adjacent the respective side surface of the base and the side surface itself, after having twisting the loop portion of the strap thereat, after which the stake is driven into the ground, which, as described above, has caused the shortening of the lifespan or use of the straps.

According to the present invention, an improved staking pin is incorporated, which obviates the disadvantages of the prior art. Specifically, the staking pin of the present invention is shown in FIG. 3, and indicated generally by reference numeral 30. The staking pin 30 includes a generally elongated metal main rod portin 32 ending in a sharpened tip for driving into the ground 34, and an enlarged head 36 at the top end of the pin, by which the hammer blows are received. Associated with the staking pin 30 is a metal clip 40 defining a pair of loops. The first loop 43 defines a somewhat smaller interior space, through which passes the main elongated rod portion 32 of the staking pin, so that the staking pin 32 and the clip 40 are united in sliding relationship. The lower end portion of the staking pin 32 is provided with a stop pin or member 32' which prevents the removal of the clip 40 from operative relationship with the main elongated portion 32 of the staking pin 30. The metal clip 40 also includes a second, somewhat enlarged, second loop 44 in which is received a portion of the strap loop-end portion of the respective strap associated along the side surface of the base. This second enlarged loop 40 has an entrance channel 44' by which the respective strap loop-end portion may be inserted into the interior of the second loop, and held therein and substantially prevented from escaping from the interior portion thereof by the end location of such entrance and its relatively narrow entrance width. The above is best seen in FIG. 2, where respective strap loop-end portion 22' is shown passing through the second enlarged loop 44 of the respective metal clip 40. While FIG. 2 only shows the strap loop-end portion 22' passing through a respective loop of the metal clip 40, the same holds true for all of the other strap end portions 22", 24' and 24". It is noted, that each of these strap loop-end portions 22', 22", 24' and 24" are those portions directly emanating from the respective channel or slot 14, 16, 18 and 20. The entrance channel 44' is defined by a chamfered wall 44" forming an integral part of the second loop portion, which chamfered wall extends interiorly of the second loop portion approximately half of the width of the second loop portion, in order to aid in the retention of the respective strap loop-end portion therein, the chamfered surface also allowing for ease of insertion.

As is clearly evident in FIGS. 1 and 2, the passing through of the respective strap loop-end portion through the smaller first loop of the metal clip 40 allows for the spacing of the staking pin 32 from the respective strap portion and the side surface of the base, in contradistinction to the prior art techniques in which the staking pin itself contacted the strap end portion and caused its tearing and breaking thereof, as above-described. As is clearly evident in FIGS. 1 and 2, the upper enlarged head portion 36 is spaced from the side surface of the base and the respective strap portion associated with the respective side surface of the base via the metal clip 40, so that all blows aimed at the upper enlarged head 36 of the staking pin 30 are received by the staking pin proper, and none, theoretically, will fall upon the side surface of the base or upon the strap loop-end portion operatively associated with the metal clip.

The metal clip 40 may be described as substantially S-shaped, in which the lower portion of the "S" is enlarged to form the enlarged second loop 44, although other shapes may, of course, be used. When using the staking pin and metal clip of the present invention, with the strap already secured in place on the base 10, the four metal clips are attached to the strap loop-end portions 24', 24", 22' and 22", in the manner clearly shown in FIGS. 1 and 2, after which the four staking pins are passed through the respective enlarged second loop portions 44 and, thereafter, driven into the ground for securing the base to the ground.

The second aspect of the present invention is shown in FIGS. 5 through 9, and is directed to a tool for threading or inserting a new strap into the base proper 10, through one of the pair of cooperating channels 14, 18 or 16, 20. This tool is best seen in FIG. 5, and is indicated generally by reference numeral 60. The tool 60 includes a generally elongated main body portion 62, made preferably of thin flat steel to provide flexibility, ending in a somewhat wider head portion 64 via a tapered section 63. The upper and somewhat enlarged section 64 has a rectangular-shaped cut-out 66, through which is passed a new strap 22 or 24 for threading it through the respective pair of channels for receiving the strap. In use, the new strap, for example strap 22, is first threaded through channel opening 66 by passing the free, non-fastener containing end 35 therethrough along only a short length thereof, although a longer length thereof may be used. After such threading, the tool is inserted through one of the channels, such as channel 20, by first inserting the free end 62' thereof, after which the entire tool is pushed through the undersurface of the upper surface of the outer covering 12, in the manner shown in FIGS. 8 and 9, where FIG. 8 shows a partial insertion of the tool 60, and where FIG. 9 shows a complete insertion thereof, which complete insertion is achieved when the enlarged head 64 has cleared and passed the other of the channels, such as channel 16. After such insertion has occurred, the strap's free end 35 is simply removed from its passage through the channel 66, and the strap is buckled together in the conventional manner above described, via the buckle 33 at the securing end thereof, which receives therethrough, in a conventional manner, the free end 35 of the strap 22.

The tool 62 of the invention allows for the continued reuse of the base after a strap or a pair of straps have broken, which hitherto has necessitated the purchase of an entire new base owing to the inability or difficulty of threading a new strap into the channels of the upper surface of the outer covering of the base. Thus, the combination of the improved staking pin with metal clip, and the tool 62 of the present invention, allows for a considerably increased lifespan of a conventional Little League base. It is noted that the insertion tool 62 is of a lengthgreater than the length between the pair of corresponding and opposed channels, such as channels 20 and 16, in order to allow for the insertion of a new strap into the upper surface of the base, by the continual pushing of the tool 62 by holding the end 64 of the tool and pushing thereon until the threading has been completed.

While a specific embodiment of the invention has been shown and described, it is to be understood that numerous changes, modifications and alterations may be made therein, without departing from the scope, spirit and intent of the invention as set forth in the appended claims. For example, the metal clip may be fixedly attached to an upper portion of the staking pin, instead of being slidably mounted, in which case the clip of the invention need only comprises one loop for receiving therein a loop-end portion of the strap.

What we claim is:

1. In an improved base assembly for use in a baseball field, wherein said base assembly comprises a base having a core and an outer covering surrounding said core, said outer covering comprising an upper surface defining a plurality of slots, and a bottom surface, two of said slots forming a first pair of oppositely-disposed slots, and another two of said slots forming a second pair of oppositely-disposed slots, and at least a pair of straps, one said strap inserted through one said pair of slots and the other said strap inserted through the other said pair of slots, each of said straps defining a first end and a second end, one of said first and second ends having means for fastening said respective strap together so that said first and second ends of said respective strap are secured together opposite said bottom surface of said outer covering, such that said respective strap forms a loop having a first longitudinal portion extending interiorly of said upper surface of said base, and a second longitudinal portion extending outwardly across said bottom surface of said base, each said strap defining a first loop-end portion and a second loop-end portion and a plurality of staking pins for securing the base to the ground via said strap loop-end portions, wherein the improvement comprises:

a plurality of clip means for joining said plurality of staking pins to said strap loop-end portions, one said clip means for one said strap loop-end portion and one said staking pin, each said clip means spacing a respective said staking pin in the lateral direction from the associated said strap loop-end portion;

each said clip means comprising a first loop portion for slidingly receiving therethrough a respective said securing pin, and a second loop portion for receiving therein a respective said strap loop-end portion, said first loop portion and said second loop portion being connected together and spaced apart by an intermediate section; said second loop portion comprising an entrance channel allowing for the insertion therethrough of a respective said strap loop-end portion for inserting said strap loop-end portion into said second loop portion; said second loop portion being substantially wider than said first loop portion, and said first loop portion being a relatively closed loop for retaining a said staking pin therein.

2. The improvement according to claim 1, wherein each said clip means is generally S-shaped, said entrance channel of said second loop portion comprising an entrance wall extending approximately half the width of said second loop portion to aid in the retention of a strap in said second loop portion.

3. The improvement according to claim 2, wherein said entrance wall is chamfered to aid in the insertion of the strap loop-end portion into the interior of said second loop portion.

4. The improvement according to claim 1, wherein each said staking pin comprises a main elongated body portion, a sharpened lower tip end, and an enlarged upper head portion for receiving hammer blows, said main elongated portion comprising a detent means for preventing a respective said clip means from escaping therefrom.

5. The improvement according to claim 1, wherein first loop portion defines a major diameter thereof less than the diameter of said enlarged head portion, so that said clip means may not be slid off from said securing pin.

6. The improvement according to claim 1, further comprising a strap-insertion tool comprising a generally flat elongated main body portion and a relatively enlarged end portion, said enlarged end portion defining a channel for the insertion therethrough of an end of a strap, wherein said insertion tool may be used for inserting a new strap into a respective pair of said slots for providing a new strap for said base when the previous strap has broken.

7. The improvement according to claim 1, wherein each said clip means is fixedly secured to an upper portion of a respective said staking pin.

* * * * *